US005779525A

United States Patent [19]

Boller

[11] Patent Number: 5,779,525

[45] Date of Patent: Jul. 14, 1998

[54] POLISHING MACHINE

[75] Inventor: Hans-Peter Boller, Fockbek, Germany

[73] Assignee: Peter Wolters Werkzeugmaschinen GmbH, Rendsburg, Germany

[21] Appl. No.: 763,198

[22] Filed: Dec. 10, 1996

[30] Foreign Application Priority Data

Dec. 15, 1995 [DE] Germany ..... 195 47 085.0

[51] Int. Cl.[6] ..... B24B 49/00

[52] U.S. Cl. ..... 451/262; 451/278; 451/446; 451/453

[58] Field of Search ..... 451/446, 63, 262, 451/267, 268, 278, 280, 283, 285, 286, 287, 288, 453

[56] References Cited

U.S. PATENT DOCUMENTS

| | | | |
|---|---|---|---|
| 1,541,001 | 6/1925 | Searles . | |
| 1,718,347 | 6/1929 | Gipe . | |
| 4,860,498 | 8/1989 | Gosis | 451/288 |
| 5,664,990 | 9/1997 | Adams et al. | 451/285 |

FOREIGN PATENT DOCUMENTS 43 00 978 A1 7/1993 Germany .

OTHER PUBLICATIONS

JP Abstract 61 230 865A.

JP Abstract 61–71 965A.

*Primary Examiner*—Eileen P. Morgan

*Attorney, Agent, or Firm*—Vidas, Arrett & Steinkraus, P.A.

[57] ABSTRACT

A polishing machine comprising a frame, an upper and a lower working wheel each having opposing working surfaces, at least one of the working wheels being rotatably supported by the frame and driven by driving means, with a plurality of runner wheels being located between the working surfaces of the upper and the lower working wheel, the runner wheels having aperatures for the accommodation of work pieces and a toothing at the circumference thereof, an outer and an inner circular row of equally spaced pins, the pins being retained by a respective pin ring, the toothing of the runner wheels engaging the outer and the inner row of pins for the forward and rotating movement of the runner wheels if at least one of the row of pins is rotated, second driving means for the rotating row of pins, a source for the supply of working fluid and/or rinsing fluid between the working surfaces, interception means on the outer and the inner side of the working wheels, with the outer of the interception means being formed by a first ring attached to and encircling the outer pin ring, whereas the inner interception means is formed by a second ring which is located radially inwardly of the inner row of pins, a passage being formed between the outer pin ring and the outer working wheel and the inner ring and the lower working wheel, respectively, and being adapted to pass the working or rinsing fluid deflected by the rings downwardly into an annular collection channel which is located between the lower working wheel and a gate and adapted to selectively connect the channels to a recycling tank or another discharge, respectively.

9 Claims, 6 Drawing Sheets

POLISHING MACHINE

The invention refers to a polishing machine.

In such machines usually liquid or flowable working fluid, e.g. polishing agent, is used. For technical and environmental reasons, it is intended to re-use the working fluid. It is already known to provide a collecting tub below the working wheel into which the laterally exiting working fluid is discharged. Such collecting means is disadvantageous under multiple aspects.

As already mentioned the working fluid exits radially outwardly and radially inwardly. In case no measures are taken the working fluid flows downward on the inner and the outer side of the machine and contaminates corresponding parts thereof. The working fluid itself is contaminated by contaminated surfaces of the machine which affects the re-use. It is further disadvantagenous that the time the working fluid needs from its exit to the entrance into the tub is relatively long. Along its travel path to the collecting tub the fluid tends to crystallize so that it cannot be recycled.

The invention provides for a polishing machine wherein the working fluid is quickly passed to a recycling container without contacting metallic parts.

In the machine according to the invention interception means are located on the inner and the outer side of the working wheels, which means deflecting laterally outwardly exiting working fluid in at least one annular collection channel below the lower working wheel. A gate is associated with the channel to selectively pass the working fluid from the channel to a recycling container or to a discharge means. The interception means can be formed by a ring or the like, preferably of plastic material which intercepts the radially exiting working fluid and deflects it downwardly. Preferably, a passage is formed between the retaining ring for the outer row of pins and the working wheels for guiding the working fluid downwardly into an annularly extending channel. With respect to the outer row of pins an annular channel can be located immediately beneath the passage. Preferably, the working wheels are sheathened by a thin sheath of hard corrosion resistent material which is not attacked by the working fluid or shows no reaction with the working fluid, respectively. The other portion of the upper working wheel is to be surrounded by a sheath while the sheath for the lower working wheel extends downwardly beyond the wheel in order to secure that the working fluid flows to the collection channel. With respect to the second channel concentrically arranged inside of the first channel into which the inwardly exiting fluid is passed an arrangement radially outwardly of the inner row of pins is to be preferred, with an interception surface being provided below the gap between the working wheels onto which the radially inwardly exiting working fluid impinges. From this surface the working fluid can be passed to the second annular channel through a suitable conduit.

In case of two annular channels the outlets thereof are preferably arranged such that they are close together and can be aligned with a gate. The gate can be formed by a horizontally displaceable tank which is selectively aligneable with a recycling container or another drainage means, e.g. the water drainage system. A pneumatic cylinder can be used for the displacement of the gate.

In order to achieve a plan parallel machining the outer row of pins is rotatably driven. Therefore, it would be advantageous to couple a wiper element with the outer row of pins which immerses into the outer collection channel in order to convey the collected fluid to the outlet. In case the outer row of pins is liftable, the wiper element can be contemporarily displaced with such a lifting step. Therefore, it has to be taken care that also the channel is lifted upon the lifting movement of the outer row of pins.

The interception ring is preferably made of plastic material. Also the interception tank and occasionally a discharge tube and also other parts contacted by the working fluid are preferably made of plastic material in order to avoid a reaction between the working fluid and these parts.

The machine described enables a fast and clean discharge of the working fluid for recycling purposes. A crystallization of the working fluid is reduced to a minimum.

An embodiment example of the invention is subsequently described along the accompanying drawings.

Figure 1:
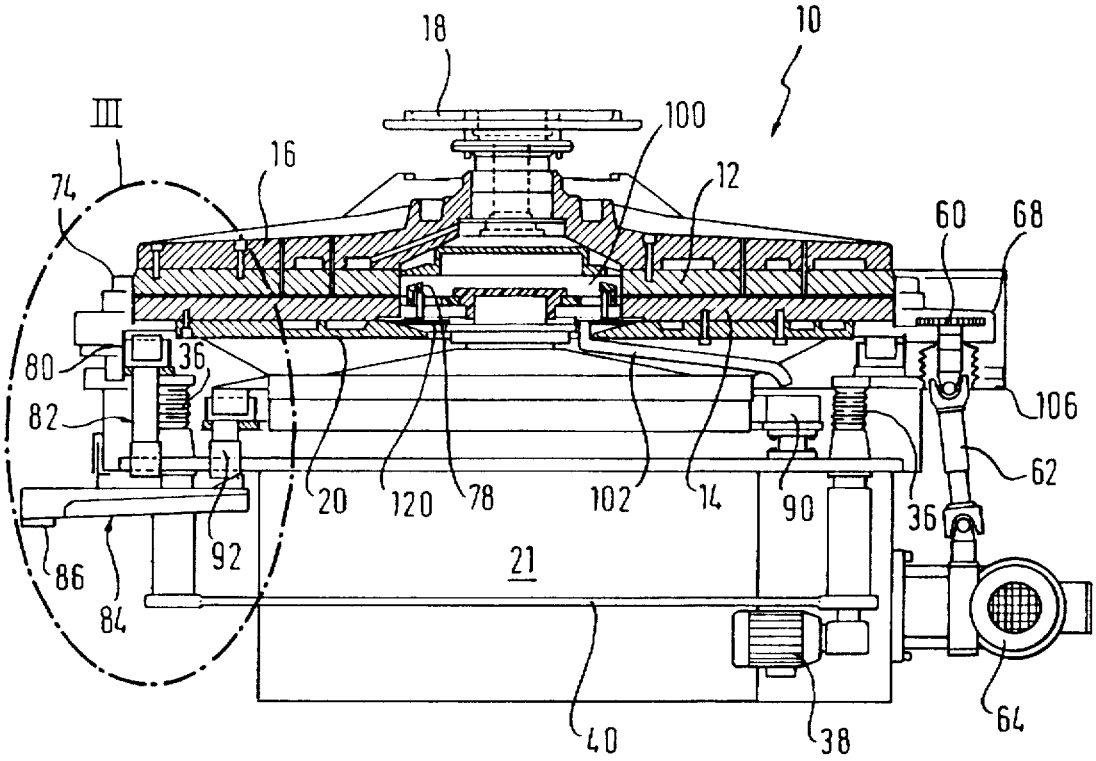
FIG. 1 shows diagrammatically an apparatus according to the invention.

FIG. 1 illustrates a polishing apparatus 10 having an upper working wheel 12 and a lower working wheel 14. The upper working wheel 12 is threaded to a retaining plate 16 which has a flange 18 at the upper side for a connection with a device for lifting and pivoting of the working wheel 12 relative to the lower working wheel 14. The lower working wheel 14 is connected with a retaining plate 20 which in turn is threaded to a frame 22. The working wheels 12, 14 are rotatably driven by a suitable driving means (not shown) in a conventional manner.

Figure 2:
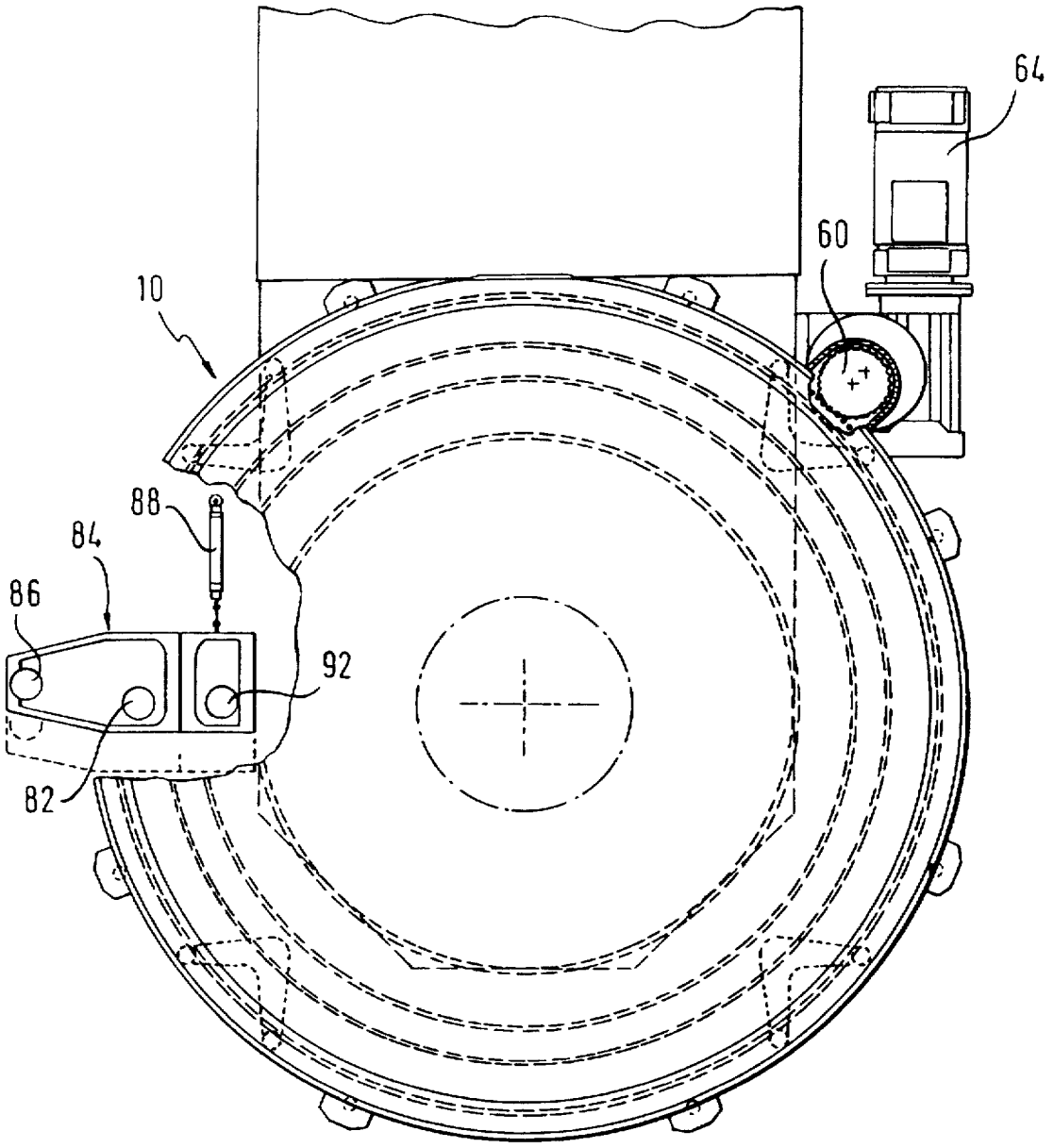
FIG. 2 shows a plan view of the apparatus of FIG. 1 including partial broken away areas.
Figure 3:
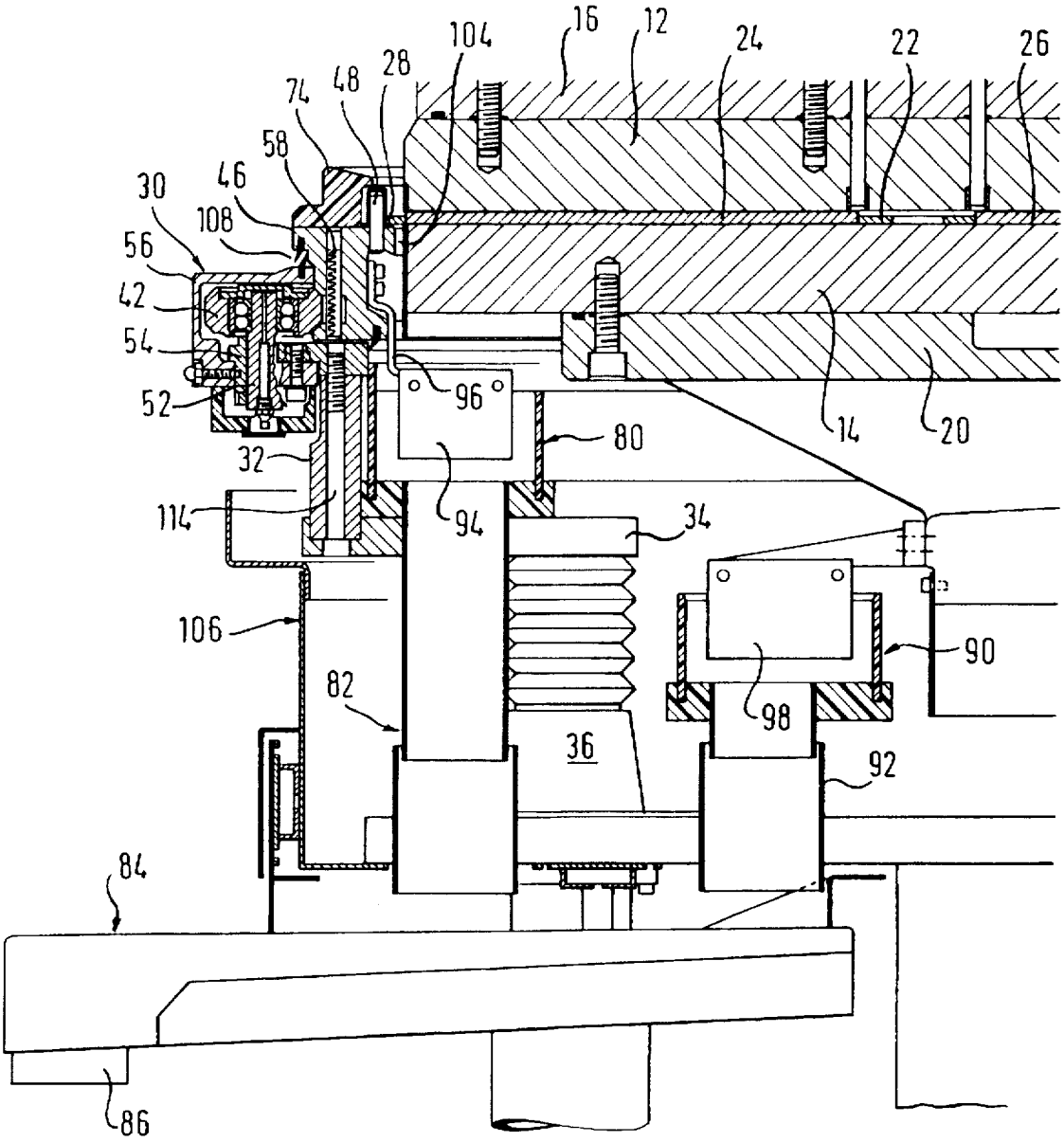
FIG. 3 shows in a larger scale the left portion of the apparatus of FIG. 1.
Figure 4:
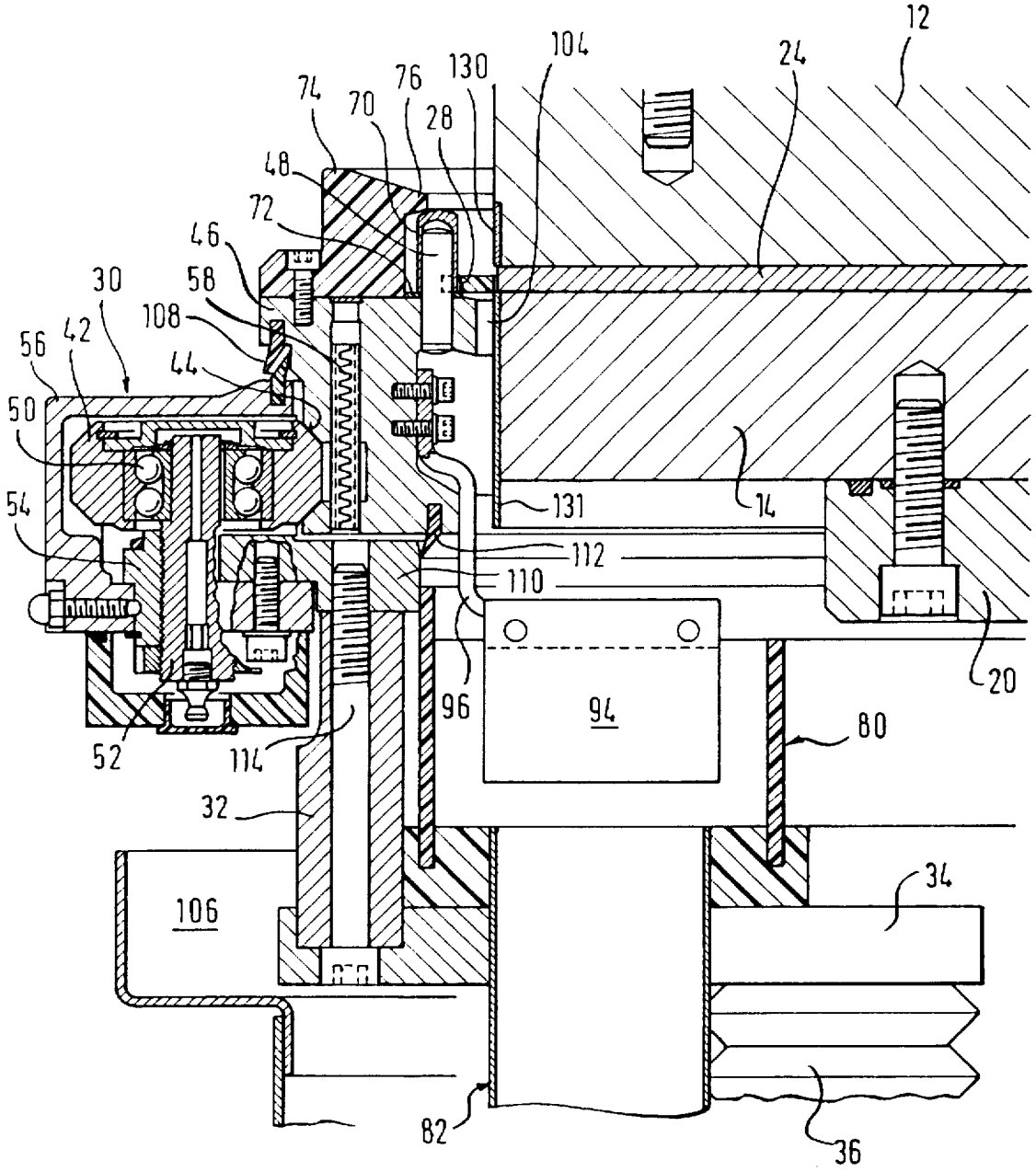
FIG. 4 shows in a larger scale the portion of FIG. 3.

In FIGS. 3 and 4 a runner wheel 22 can be seen located between the working wheels 12 and 14. The runner wheel has circular apertures for the accommodation of circular workpieces 24 or 26, respectively. The runner wheel 22 have a toothing 28 at the circumference thereof. An annular bearing member 30 is supported by plate 34 through a support portion 32. Plate 34 is supported by a lifting means 36 mounted on the frame 22. In FIG. 2 a second lifting means 36 is indicated. This lifting means is actuated by a motor 38, with a shaft 40 interconnecting both lifting devices 36. As can be seen in FIG. 4 a plurality of rollers 42 are supported by the annular bearing member 30, with the circumference of the rollers being conical in cross section. The rollers engage a groove 44 at the periphery of a pin ring 46 conical in cross section, the ring 46 being provided with a plurality of pins of an outer row of pins. The pins are mounted in corresponding bores as shown at 48 in FIGS. 3 and 4 and fastened by an interference fit. The bearing of the rollers 42 takes place by a roller bearing 50 which is located on a bearing pin 52 having a free end sitting in a threaded sleeve 54 which in turn is rotatably supported by bearing ring 56. A rotation of pins 52 thus leads to an axial or vertical displacement of roller 42, and a rotation of sleeve 54 results in a radial displacement thereof because sleeve 54 is eccentric. Thus, the relative position of pin ring 46 can be changed relative to bearing ring 30.

Figure 5:
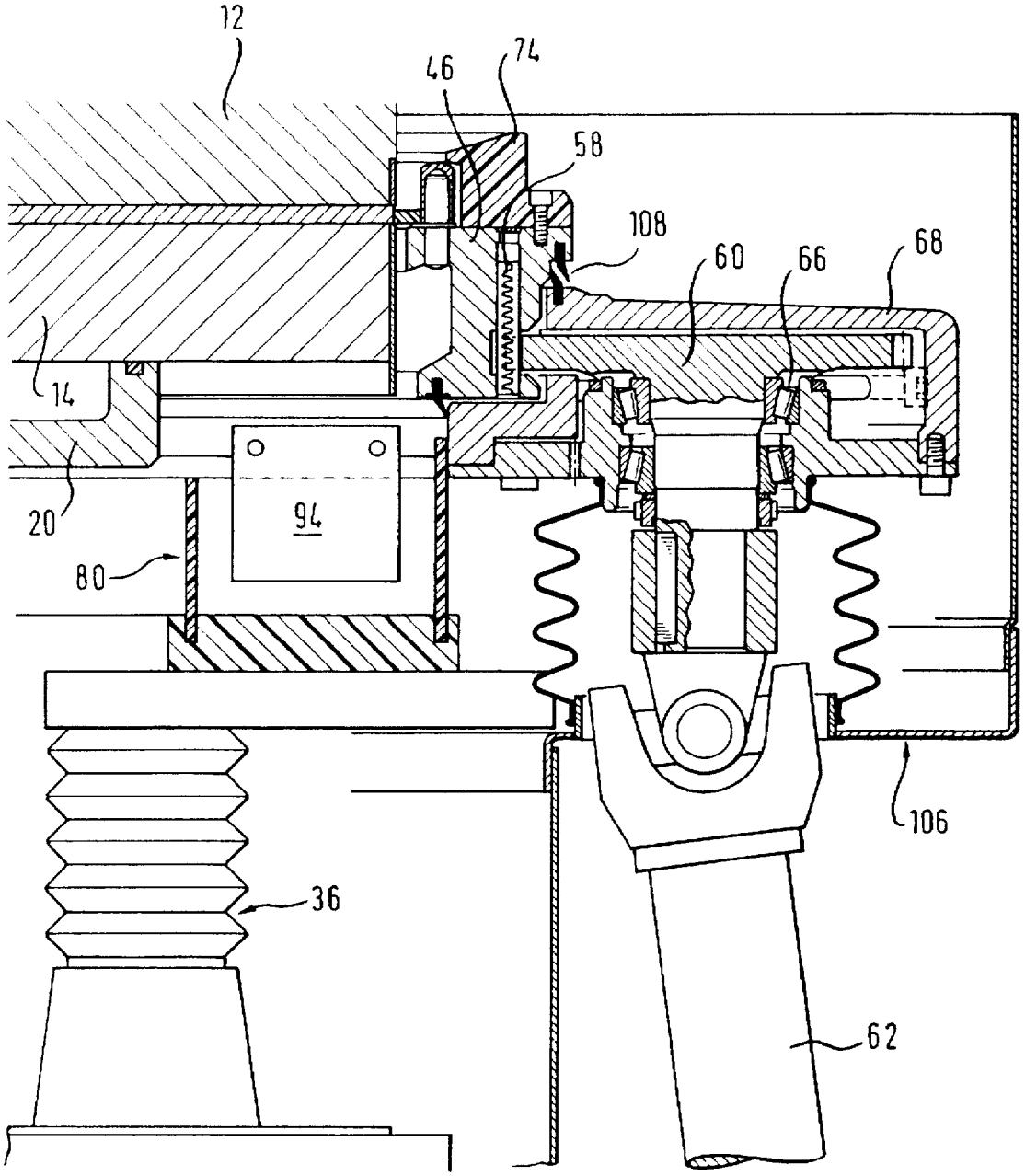
FIG. 5 shows in a larger scale the right portion of the apparatus of FIG. 1.
Figure 6:
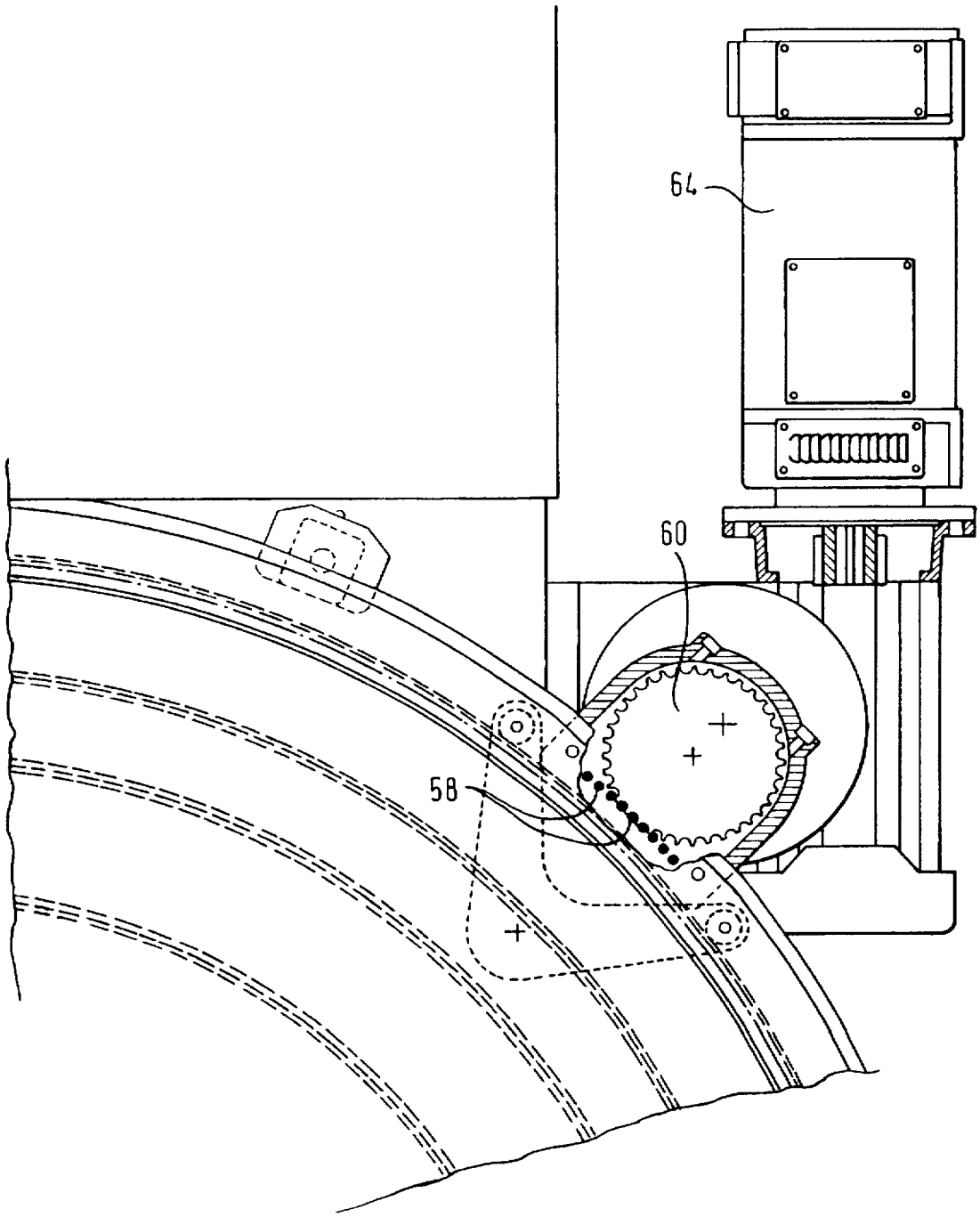
FIG. 6 shows in a larger scale a portion of the illustration of FIG. 2.

Dowel pins 58 are accommodated by the pin ring 46 in equally circumferencially spaced relationship. The dowel pins extend transverse to groove 44. As can be seen in FIGS. 2 and 5 a pinion 60 engages the dowel pins 58. The pinion 60 is driven by a gear motor 64 through a universal joint shaft 62 whereby the pin ring with the pins are rotated. The universal joint shaft 62 is telescopic so that this driving connection is independent from the level of pin ring 46 which, as mentioned, can be raised or lowered by lifting means 36. The pinion 60 is rotatably supported in a housing 68 by means of a roller bearing.

As can be particularly seen in FIG. 4 a sleeve 70 is placed on each pin of the pin ring from above, the upper end of sleeve 70 being closed while the lower end is supported by the pin ring through a washer 72 of polyamide. As can be seen, the toothing 28 of the runner wheel 22 engages the outer circumference of the sleeve. A ring 74 of plastic material is threaded to the upper side of pin ring 46 and provides an upper radially inwardly extending flange 76 which partially extends over the sleeves 70 and thus prevents the sleeve from being lifted or removed. An inner row of pins is accommodated by a ring 78 which is fixedly secured to the lower plate 20, and a ring 74 of plastic material extends above the inner pins.

An annularly extending channel 80 is located on a plate 34, the channel being in communication with the upper side of a gate 84 through a telescopic conduit 82. Gate 84 is shown in FIG. 2 in a plan view. It can be displaced a limited amount by a cylinder 88 as shown by dotted lines. The outlet 86 of gate 84 can be selectively aligned with a desired drain. As can be seen in FIG. 2 a further annularly extending channel 90 adapted to be raised or lowered by a suitable lifting means can be aligned with gate 84 through a telescopic tube 92. A wiper blade 94 is fixed to the inner side of pin ring 46 through an arm 96. Upon rotation of pin ring 46 blade 94 moves in channel 80 and conveys liquid in the channel towards the telescopic tube 82 and thus to gate 84. A further blade 98 is located in the annular channel 90 and is also rotatably driven in order to move liquid into the telescopic tube 92 and thus to gate 84.

Particularly with a polishing process for workpieces 24 a relatively large amount of polishing or rinsing liquid is necessary. The liquid either exits at the outer side between the working wheels 12, 14 or at the inner side in the hollow space 100 between the working wheels (FIG. 1). From the hollow space 100 the liquid flows through a stationary tube 102 into the inner channel 90. Outwardly exiting liquid is prevented by a ring 74 from flowing more outwardly, rather flows downwards through passages or channels 104 between pin ring 46 and lower working wheel 14 into channel 80. It can be seen that nearly the total working fluid is collected in channels 80 and 90 and led to a recycling tank (not shown) or to a drainage system, respectively, in correspondence with the position of gate 84. The complete arrangement shown is additionally encircled by a tank 106 wherein the fluid not collected by the channels 80 and 90 is collected. A thin jacket 130 or 131, respectively, is located on the circumference of the working wheels which consists of hard corrosion resistent material and therefore, is not attacked by the working fluid. Jacket 131 extends upwardly beyond wheel 14 and serves for the deflection of a fluid towards channel 80.

A lip sealing 108 is located between the annular bearing structure 30 or the bearing ring 56, respectively, and the pin rin 46 in order to prevent penetration of contamination or the discharge of liquid. A further lip sealing is located between the lower side of pin ring 46 and a ring 110. The sealing is designated with 112. Ring 110 is connected to the support member 32 through dowel pins 114 and in turn retains bearing ring 56.

As can be seen, the complete working fluid is collected and can be processed and re-used. It can be further seen that by means of the lifting devices 36 the pin ring 46 and thus the pins can be lowered as much as necessary that the runner wheels 22 can be simply displaced on the lower working wheel or unloaded by sliding them away from the upper surface of the lower working wheel.

I claim:

1. A polishing machine comprising a frame, an upper and a lower working wheel each having working surfaces opposing each other, said working wheels leaving an inner and an outer circumference, at least one of said working wheels being rotatably supported by said frame and driven by driving means, with a plurality of runner wheels being located between said working surfaces of said upper and said lower working wheel, said runner wheels having apertures for the accommodation of work pieces and a toothing at the circumference thereof, an outer and an inner circular row of equally spaced pins said outer row of pins being located around said outer circumference of said working wheels and said inner row of pins being located inside of said inner circumference of said working wheels, said pins being retained by a respective pin ring, said toothing of said runner wheels engaging said outer and said inner row of pins for the forward and rotating movement of said runner wheels if at least one of said row of pins is rotated, second driving means to rotate at least one row of pins, a source of the supply of working and/or rinsing fluid between said working surfaces, interception means on the outer and inner side of said working wheels, with the outer of said interception means being formed by a first ring attached to and encircling said outer pin ring, whereas said inner interception means is formed by a second ring which is located radially inwardly of said inner row of pins, passages being formed between said outer pin ring and the circumference of said lower working wheel, and said inner ring and the inner circumference of said lower working wheel, respectively, and being adapted to pass said working or rinsing fluid deflected by said rings downwardly into annular collection channels which are located between said lower working wheel, and a gate adapted to selectively connect said channels to a recycling tank or another discharge, respectively.

2. The machine of claim 1, wherein said channels are concentrically arranged.

3. The machine of claim 1, wherein a stationary collecting surface is located on the inner side of said working wheels and below said second ring, said working surface being in communication with said inner channel.

4. The machine of claim 1, wherein each of said channels includes an outlet opening, said outlet openings being close together and radially arranged with respect to said working wheels and jointly aligned with said gate.

5. The machine of claim 1, wherein a wiper element is attached to said rotatably driven outer row of pins, said wiper element immerses into the associated channel, and a further wiper element is coupled with said lower working wheel and immerses into a further stationary channel.

6. The machine of claim 1, wherein upon a vertical adjustment of said row of pins by means of a lifting device said channels are coupled with sasid lifting device.

7. The machine of claim 1, wherein said rings have a radially inwardly or radially outwardly extending flange, respectively.

8. The machine of claim 1, wherein said gate is formed by a horizontally displaceable tank having an outlet which can be selectively brought into communication with said recycling tank or another drainage means.

9. The machine of claim 2, wherein a stationary collecting surface is located on the inner side of said working wheels and below said second ring, said working surface being in communication with said inner channel.

* * * * *